US012006828B2

(12) United States Patent
Kokura

(10) Patent No.: US 12,006,828 B2
(45) Date of Patent: Jun. 11, 2024

(54) DISPLACEMENT PUMP FOR FUEL VAPOR RECOVERY

(71) Applicant: TATSUNO CORPORATION, Tokyo (JP)

(72) Inventor: Naohiro Kokura, Tokyo (JP)

(73) Assignee: TATSUNO CORPORATION, Tokyo (JP)

( * ) Notice: Subject to any disclaimer, the term of this patent is extended or adjusted under 35 U.S.C. 154(b) by 0 days.

(21) Appl. No.: 16/538,536

(22) Filed: Aug. 12, 2019

(65) Prior Publication Data

US 2020/0063743 A1 Feb. 27, 2020

(30) Foreign Application Priority Data

Aug. 24, 2018 (JP) ..... 2018-157021

(51) Int. Cl.
*F01C 21/10* (2006.01)
*F04C 29/00* (2006.01)

(52) U.S. Cl.
CPC ..... *F01C 21/102* (2013.01); *F04C 29/0021* (2013.01); *F04C 29/0078* (2013.01); *F04C 2270/175* (2013.01)

(58) Field of Classification Search
CPC ..... F01C 21/102; F04C 29/0078; F04C 29/0021; F04C 2270/175; F04C 2270/17; F04C 15/0042; F04C 15/0076; F16C 19/54; F16C 25/06; F16C 25/083
See application file for complete search history.

(56) References Cited

U.S. PATENT DOCUMENTS 1,631,557 A * 6/1927 Sponable ..... F16C 25/06 411/315
3,295,262 A 1/1967 Brown
3,528,757 A * 9/1970 Ware ..... F01C 21/102 418/107
3,642,389 A * 2/1972 Chambers ..... F01C 13/02 418/107
3,804,562 A * 4/1974 Hansson ..... F16C 19/548 418/107

(Continued)

FOREIGN PATENT DOCUMENTS

CN 105649989 A * 8/2016
JP S61277884 12/1986

(Continued)

OTHER PUBLICATIONS

English translation of CN105649989A, from Espacenet website generated Mar. 27, 2023 (Year: 2023).*
European Search Report for EP 19 19 3092; mailed Nov. 29, 2019.

*Primary Examiner* — Bryan M Lettman
(74) *Attorney, Agent, or Firm* — Stetina Brunda Garred & Brucker

(57) ABSTRACT

A displacement pump is configured to allow for assembly while properly maintaining side clearances. The displacement pump (100, 101, 102, 103, 104, 105) for sucking and discharging a fluid such as gasoline vapor by changing pressure in a space constituted by an outer peripheral surface of a rotor (1) and an inner wall surface of a casing (2), includes a side clearance adjusting member (4), rotating with respect to the pump main body (6), for moving a shaft (3) integrally formed with the rotor (1) in an axial direction of the shaft (3).

17 Claims, 9 Drawing Sheets

(56) References Cited

U.S. PATENT DOCUMENTS

| | | | | |
|---|---|---|---|---|
| 2013/0251581 | A1* | 9/2013 | Christov | F04C 2/00 418/191 |
| 2015/0110661 | A1* | 4/2015 | Tanaka | F04C 29/0078 418/259 |
| 2016/0040711 | A1* | 2/2016 | Boufflert | F16C 19/06 384/500 |

FOREIGN PATENT DOCUMENTS

| | | |
|---|---|---|
| JP | S2150094 | 7/1987 |
| JP | 3271702 | 5/2010 |
| JP | 2014-70545 | 11/2016 |

* cited by examiner

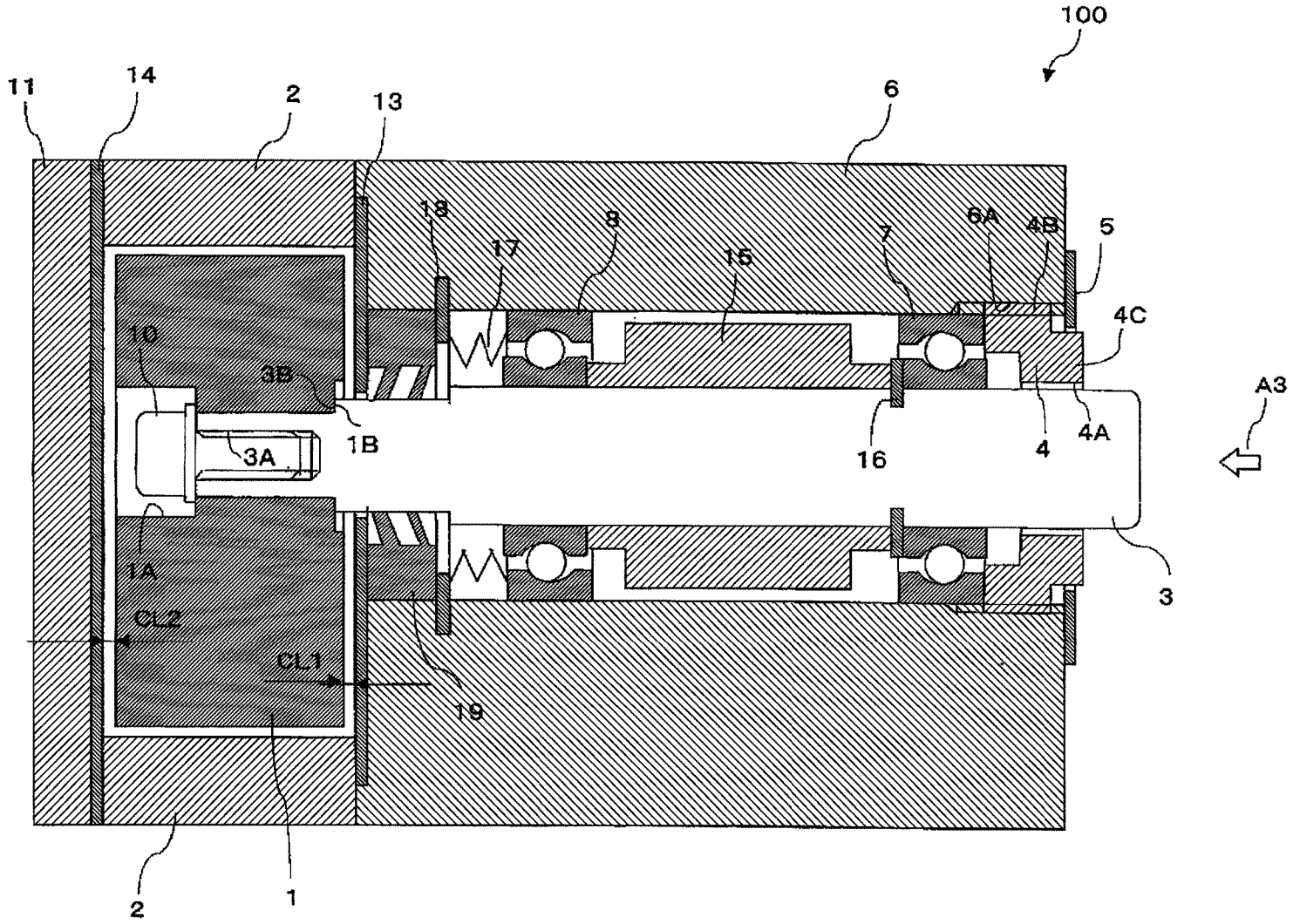
[Fig. 1]

【Fig. 2】
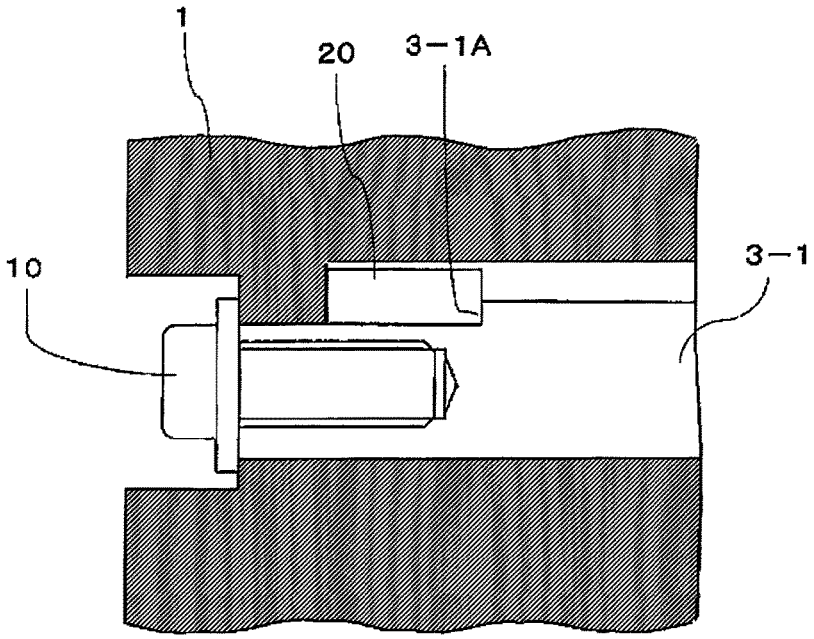
【Fig. 3】
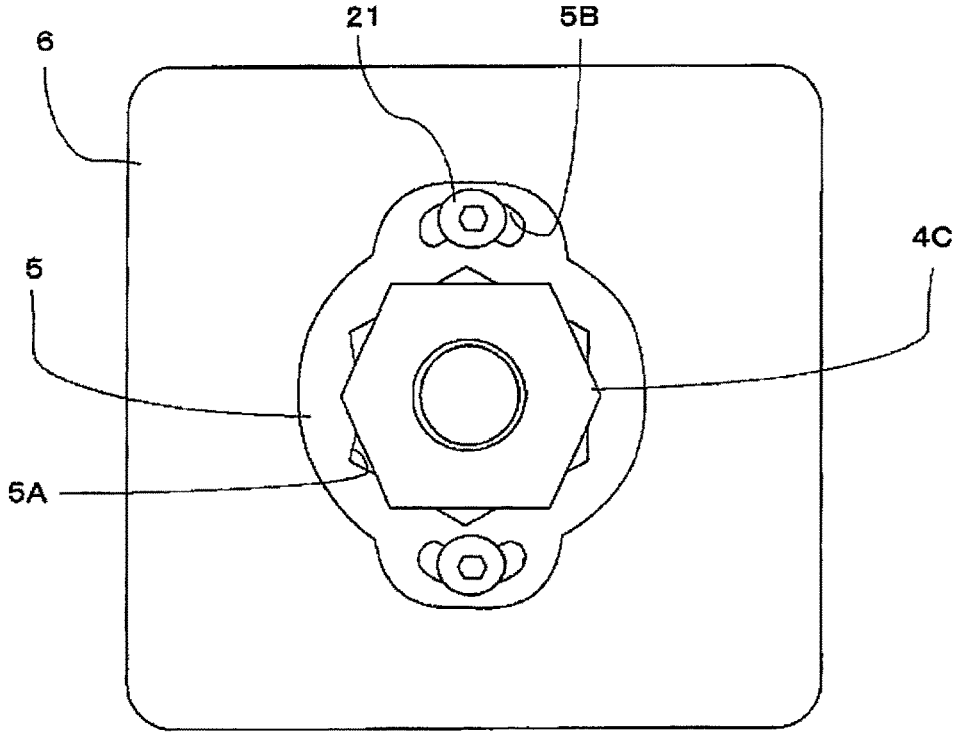

【Fig. 4】
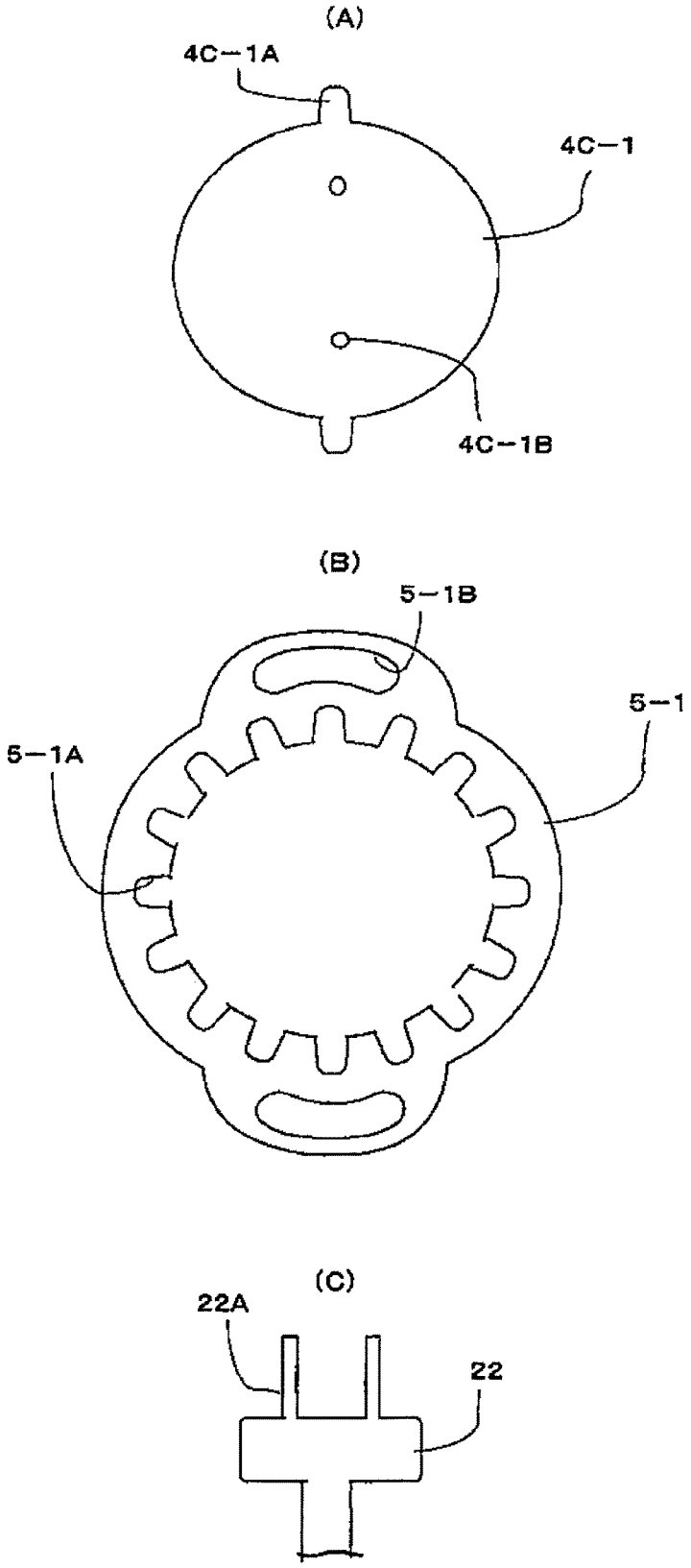

【Fig. 5】
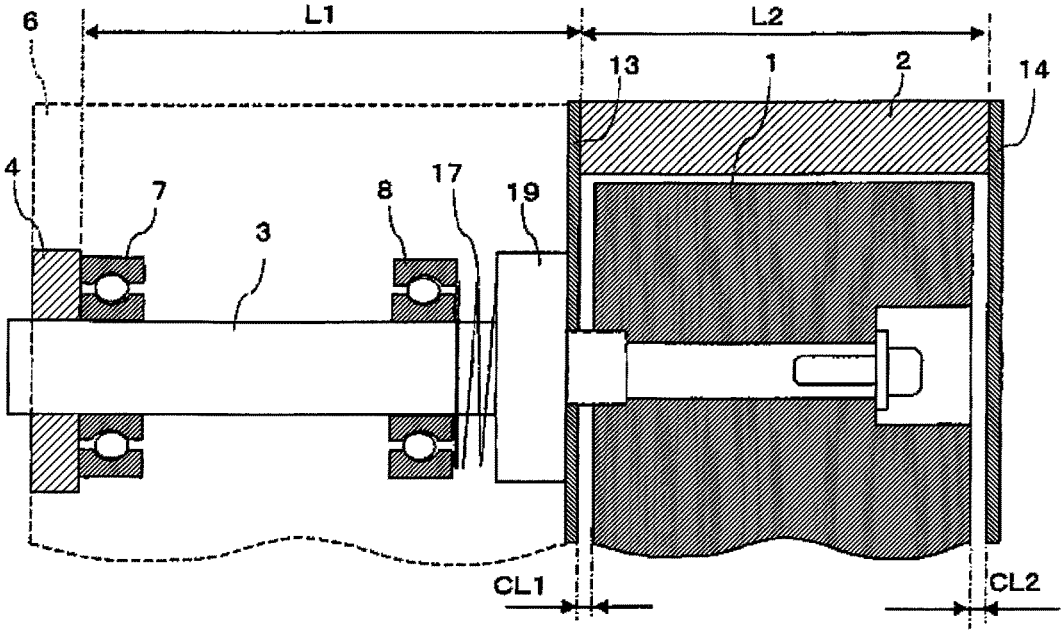
【Fig. 6】
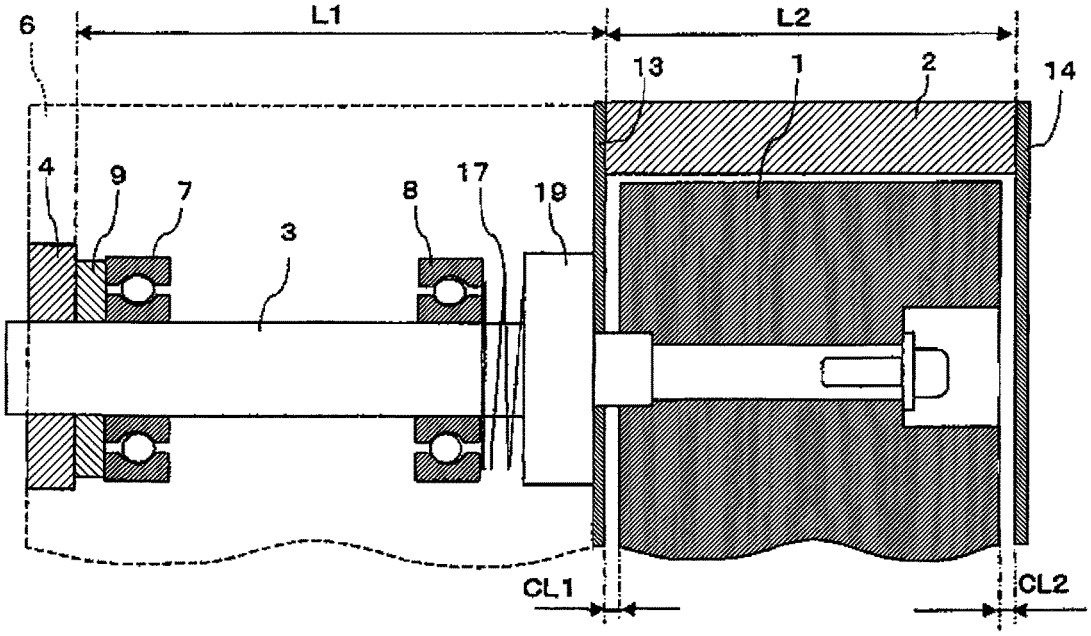

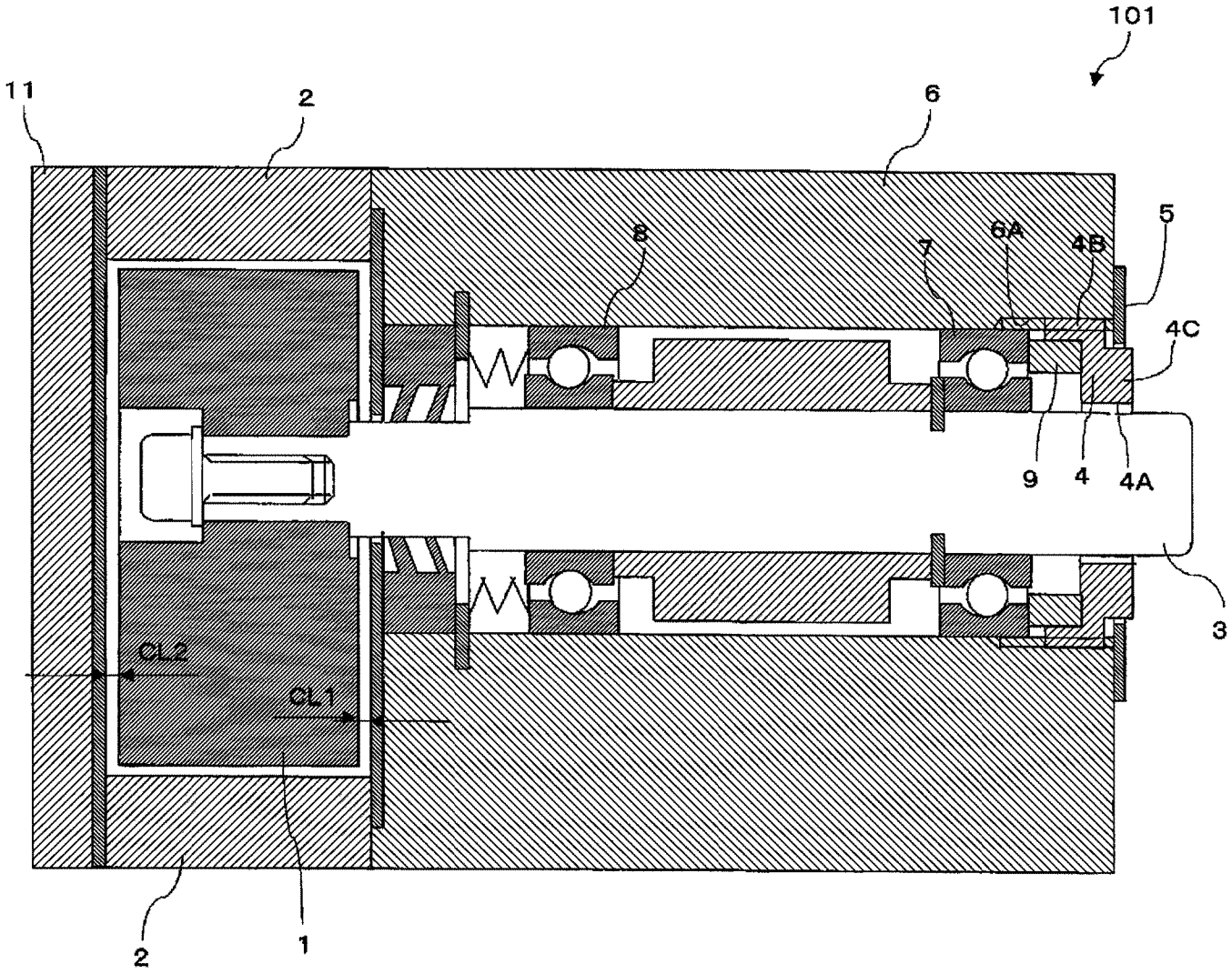
[Fig. 7]

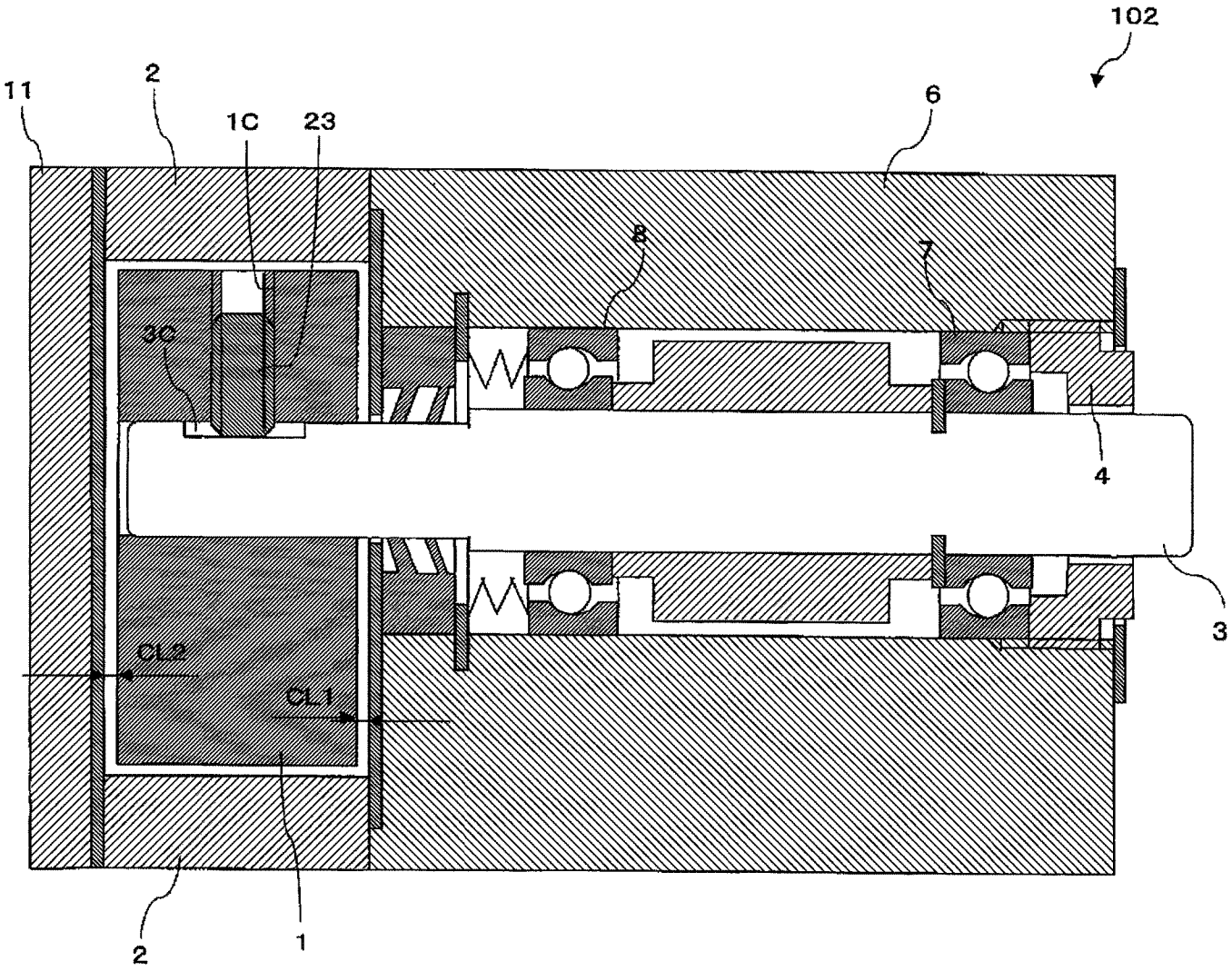
【Fig. 8】

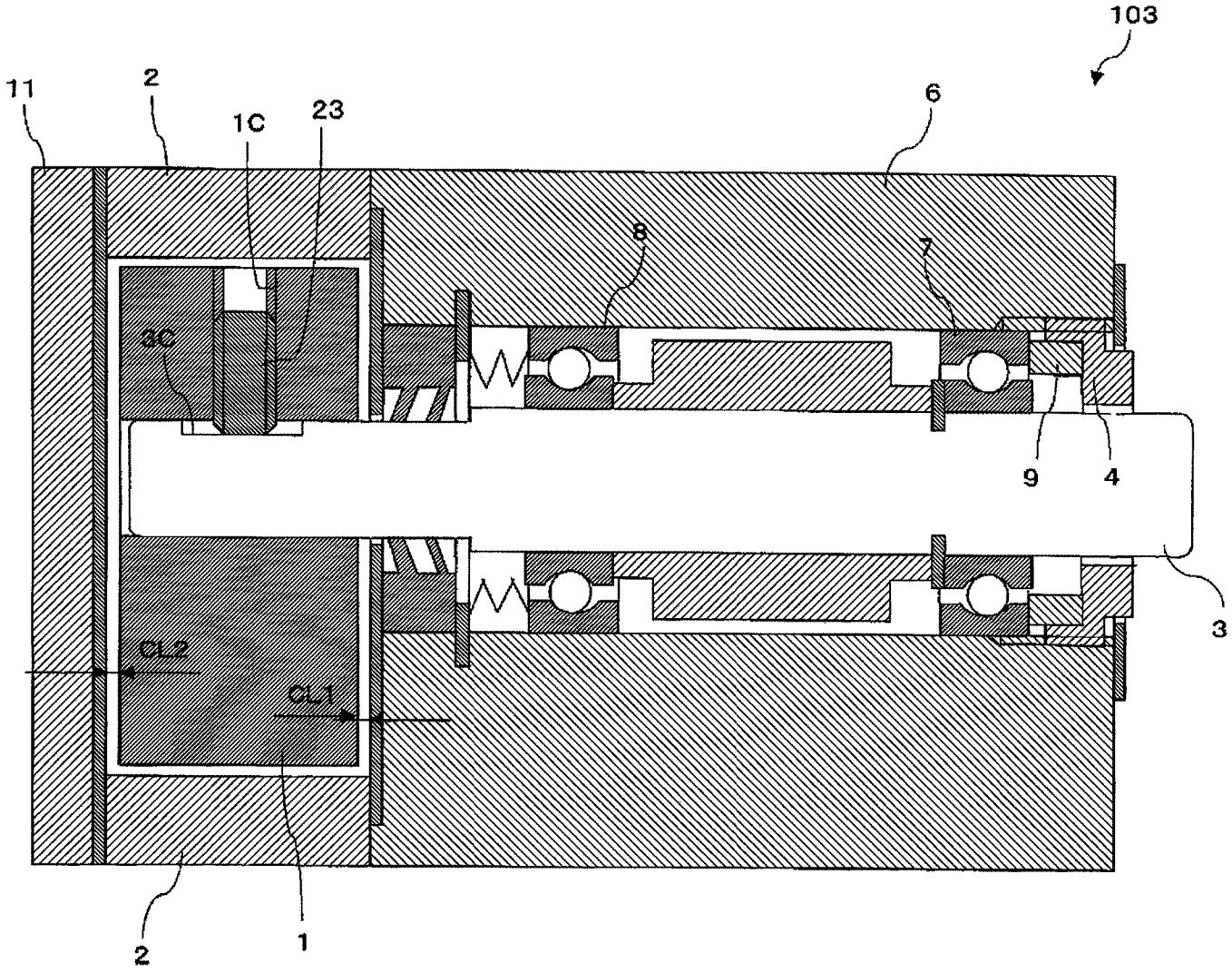
【Fig. 9】

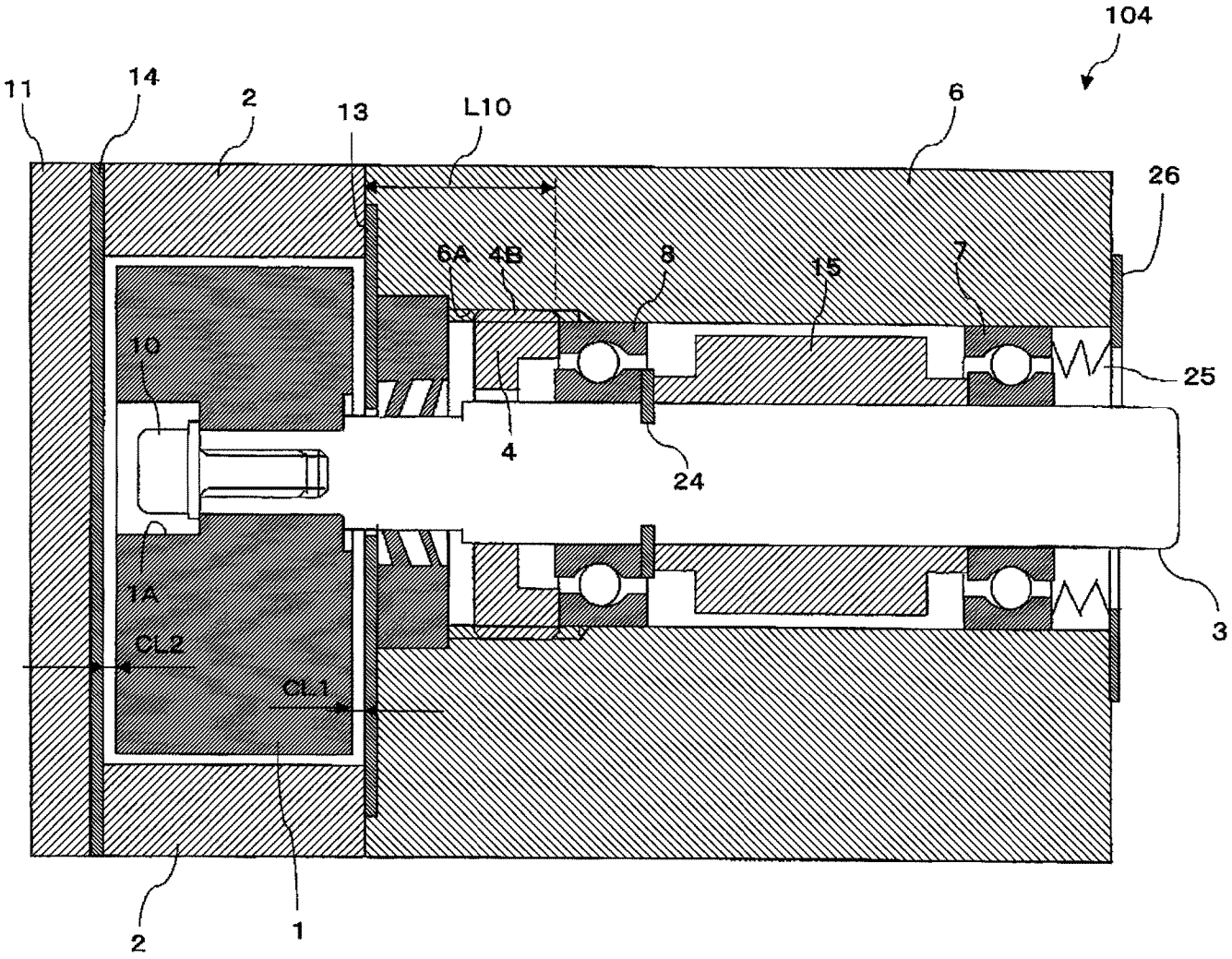
【Fig. 10】

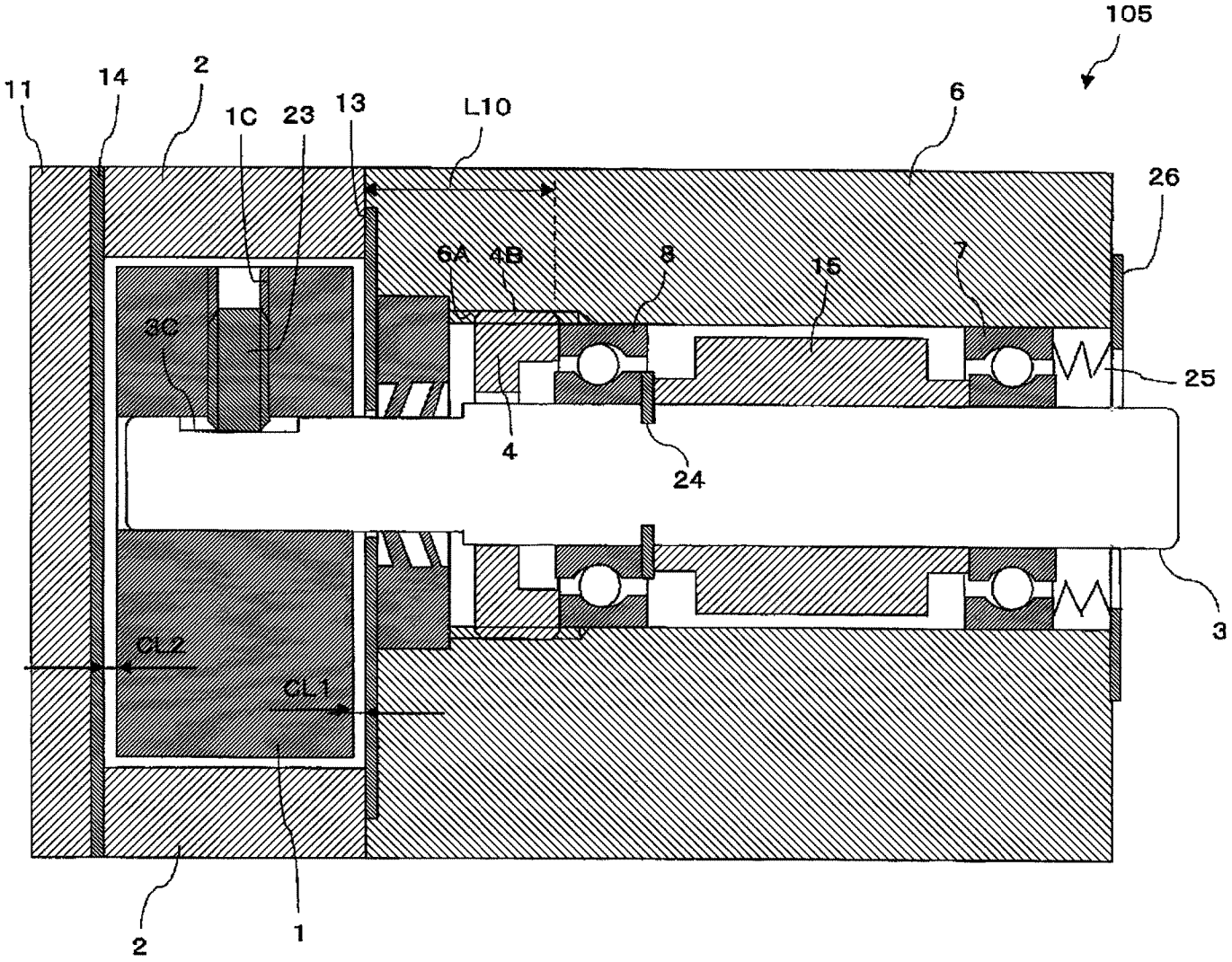
[Fig. 11]

DISPLACEMENT PUMP FOR FUEL VAPOR RECOVERY

CROSS-REFERENCE TO RELATED APPLICATIONS

The present application claims priority to Japanese Application No. 2018-157021 filed on Aug. 24, 2018, the disclosure of which is incorporated herein by reference.

STATEMENT RE: FEDERALLY SPONSORED RESEARCH/DEVELOPMENT

Not Applicable

BACKGROUND

1. Technical Field of the Invention

The present invention relates to a displacement pump such as a vane pump for sucking and discharging fluid such as gasoline vapor by changing pressure in a space constituted by an outer peripheral surface of a rotor and an inner wall surface of a casing while rotating the rotor.

2. Description of the Related Art

In gas stations and the like is installed a vapor recovery pump for recovering gasoline vapor that is generated when gasoline is supplied to a vehicle and others by a fueling apparatus, and returning recovered gasoline vapor to an underground tank. As the vapor recovery pump is used a vane pump that is an example of the displacement pump (refer to Japan Patent No. 3271702 gazette).

In the vane pump, it is required that a clearance (side clearance) between a rotor and a side surface (or a side plate) of a pump main body and clearances (side clearances) between vanes and the side surface (or the side plate) of the pump main body are proper. When the side clearances are set to be large, assembling of the vane pump becomes easy, and a risk of biting foreign materials decreases, but sealability decreases to decrease efficiency. On the other hand, when the side surfaces are set to be small, sealability is improved to increase efficiency, but assembling of the pump becomes difficult, and the risk of biting foreign materials increases.

In order to properly maintain the side clearances, in the conventional technique (Japan Patent No. 3271702), when the vane pump is assembled, under a condition that a thickness gage spacer (so-called "shim") is disposed between the rotor and the pump main body to secure proper side clearances, a shaft and the rotor are combined with each other by a bolt (set screw) extending in a direction perpendicular to an axial direction of the shaft, and after that, the shaft and the rotor are assembled to the pump main body.

However, it is difficult to assemble the vane pump under the condition that the thickness gage is disposed between the rotor and the pump main body. In addition, since the rotor and the shaft are fixed by friction force of the set screw only, a large external force or a temperature change (and a difference in coefficients of thermal expansion of the materials) causes positional relationship between the rotor and the shaft to be misaligned, resulting in a locked state of the rotor and the shaft.

Further, due to a fastening force, which is a clockwise force, of the set screw, the rotor turns around the screw, which makes it difficult to maintain a condition that the shaft and the side face of the rotor are perpendicular to each other.

Or, when the shaft and the rotor are connected by the set screw, a reaction force is generated by the set screw pressing the shaft, so that it is difficult to maintain that the shaft and the rotor are parallel to each other. In addition, in order to replace a worn vane, the pump main body and the casing must be disassembled, but there is a possibility that the side clearances change when they are reassembled.

As another conventional technique, for example, is proposed a displacement vane pump intended to make the clearances between the pump cover and the rotor proper (Japanese Patent Publication No. 2014-70545 gazette). However, in the patent gazette, it is not described to prevent the side clearances at the assembling and the like from changing at all.

The contents of Japan Patent No. 3271702 gazette and Japanese Patent Publication No. 2014-70545 gazette are incorporated herein by reference in their entirety.

BRIEF SUMMARY

The present invention has been proposed in consideration of the above problems in the prior art, and the object thereof is to provide a displacement pump that can be assembled while proper side clearances are maintained.

A displacement pump (100, 101, 102, 103, 104, 105) of the present invention for sucking and discharging a fluid such as gasoline vapor by changing pressure in a space constituted by an outer peripheral surface of a rotor (1) and an inner wall surface of a casing (2) is characterized by including a side clearance adjusting member (4), rotating with respect to the pump main body (6), for moving a shaft (3) integrally formed with the rotor (1) in an axial direction of the shaft (3). Here, the displacement pump preferably further includes a detent (5) for the side clearance adjusting member (4).

In the above displacement pump, the side clearance adjusting member (4) is preferably screwed to the pump main body (6) at an end portion of the shaft (3) on a side separated from the rotor (1), and a thermal expansion adjusting member (9) is preferably arranged between the side clearance adjusting member (4) and a bearing (the first bearing 7) for rotatably supporting the shaft (3), and thermal expansion coefficient of the thermal expansion adjusting member (9) is preferably larger than that of the pump main body (6) for accommodating the shaft (3).

In the above displacement pump, the shaft (3) and the rotor (1) are preferably fixed to each other by a bolt (a stud bolt 10) extending in an axial direction of the shaft (3). And, it is preferable to mount plate members (side plates 13, 14) separately from the pomp main body (6) and the lid (cover 11) at positions opposite to the both side faces of the rotor (1).

A displacement pump assembling method of the present invention, which assembles the displacement pump (100, 101, 102, 103, 104, 105) is characterized by including the steps of: measuring (with a dial depth gage, for instance) a distance (difference in positions in the axial direction of the shaft 3) between the rotor (1) and an end surface of the casing (2) just before assembling a displacement pump (immediately before attaching the lid 11, for example); determining a side clearance of the rotor (1) based on a measurement result of the measurement; enlarging the side clearance (CL1) of the rotor (1) by fastening the side clearance adjusting member (4) to move it toward the rotor (1) when the side clearance (CL1 or CL2) is smaller than a proper value, or reducing the side clearance (CL1) of the rotor (1) by unfastening the side clearance adjusting member (4) to move it so as to be separated from the rotor (1) when the side clearance is larger than the proper value; and attaching the lid (11) after the side clearance adjusting.

Here, in the side clearance adjusting, the side clearance (CL2) on the lid (11) side (on the second side plate 14 side) and the side clearance (CL1) on the pump main body (6) side (on the first side plate 13 side) of the rotor (1) are contradictory to each other, so that when decreasing the side clearance (CL2) on the lid (11) side, fastening the side clearance adjusting member (4) enlarges the side clearance (CL1) on the pump main body (6) side, and when increasing the side clearance (CL2) on the lid (11) side, unfastening the side clearance adjusting member (4) decreases the side clearance (CL1) on the pump main body (6) side.

With the present invention with the above construction, rotating the side clearance adjusting member 4 to move it toward the rotor 1 side allows the shaft 3 to move on the rotor 1 side or the side separate from the rotor 1 through the bearings (7) (8) rotatably supporting the shaft (3). Here, moving the shaft 3 on the rotor 1 side causes the side clearance between the rotor 1 and the pump main body 6 (side clearance on the pump main body 6 side: CL1) to be enlarged. On the other hand, moving the shaft 3 on the side separate from the rotor 1 causes the side clearance between the rotor 1 and the pump main body 6 (side clearance on the pump main body 6 side: CL1) to be decreased.

As a result, when assembling the displacement pump (100, 101, 102, 103, 104, 105), in a stage just before assembling (a stage that attaching the lid 11 completes assembling work, for example), even if an inappropriate value of side clearance (a distance between the rotor 1 and an end face of the casing 2) is measured (through measurement by a dial depth gage for instance), without disassembling assembled parts, appropriately rotating the side clearance adjusting member 4 allows the side clearance (CL1) to be appropriate value. Since the side clearance (CL1) can be an appropriate value in the above manner, with the present invention, it is unnecessary to perform assembling work while putting a depth gage between the rotor 1 and the pump main body 6, resulting in easy assembling work.

In addition, even if the side clearance (CL1) changes by disassembling and reassembling the pump main body 6 and the casing 2 when replacing worn vanes, rotating the side clearance adjusting member 4 allows the shaft (3) to move on the rotor 1 side or the side separate from the rotor 1, so that replacement of the worn vanes and assembly of the vane pump can certainly be carried out with ease, and the side clearance (CL1) can properly be maintained.

In the present invention, when a thermal expansion adjusting member (9) is arranged between the side clearance adjusting member (4) and the first bearing (7) and the thermal expansion adjusting member (9) is formed with a material whose thermal expansion coefficient is larger than that (aluminum for instance) of the pump main body (6), since the side clearance adjusting member 4 is screwed to the pump main body 6 at an end of the shaft 3 on a side separated from the rotor 1, when the pump works under high temperature environment, expanding the thermal expansion adjusting member 9 in the axial direction of the shaft 3 presses the first bearing 7 toward the rotor 1, which increases the side clearance (CL1). As a result, even if the side clearance (CL1) of the rotor (1) decreases due to difference in thermal expansion coefficient between material (aluminum for instance) of the pump main body 6 and material (S45C for instance) of the shaft (3) and the rotor (1), the thermal expansion adjusting member (9) expands in the axial direction of the shaft (3) to enlarge the side clearance (CL1), so that fluctuation of the side clearance (CL1) of the rotor 1 becomes totally small, which mitigates effect caused by fluctuation of the side clearance (CL1) due to thermal expansion.

In the present invention, when the shaft (3) and the rotor (1) are fixed to each other by a bolt (stud bolt) 10 extending in the axial direction of the shaft (3), a force fixing the rotor 1 and the shaft 3 to each other becomes large in comparison to the case where the fixing of the rotor 1 and the shaft 3 through frictional force of a set screw only, even when a large external force or a temperature change (and a difference in coefficients of thermal expansion of the materials) occur, positional relationship between the rotor (1) and the shaft (3) is not easily misaligned. Therefore, it becomes unnecessary to fix the rotor 1 and the shaft 3 from a direction perpendicular to the axis of the shaft 3, and it becomes unnecessary to drill a through hole extending in a direction perpendicular to the axis of the rotor 1, so that the shaft 3 is never pressed from a side.

In addition, when the shaft 3 and the rotor 1 are incorporated, no reaction force acts in a direction perpendicular to the axis of the shaft 3, so that the shaft 3 and the rotor 1 are maintained in a condition that they are parallel with each other. Further, when the stud bolt 10 for fixing the rotor 1 and the shaft 3 to each other is fastened, and through the fastening force rotates the rotor 1 around the stud bolt 10, the rotor 1 rotates around the axis of the shaft 3, so that the stud bolt 10 is never inclined to the shaft 3, which maintains a condition that the shaft 3 and the side face of the rotor 1 are mutually orthogonal. And, a roughness and so on at an end face of the stud bolt 10 for fixing the rotor 1 and the shaft 3 to each other does not become a cause that the rotor 1 is inclined to a position perpendicular to the shaft 3, so that the rotor 1 is not inclined to a position perpendicular to the shaft 3, which can maintain appropriate side clearance. As a result, there is no fear that the rotor 1 and shaft 3 are in a locked state.

In the present invention, mounting plate members (side plates 13, 14) separately from the pomp main body (6) and the lid (cover 11) at positions opposite to the both side faces of the rotor (1) allows materials of the pump main body 6 and the lid (cover) 11 can be selected regardless of surface roughness and wear resistance, which increases flexibility of material selection.

BRIEF DESCRIPTION OF THE DRAWINGS

FIG. 1 is a cross sectional side surface view showing the first embodiment of the present invention;

FIG. 2 is a partial cross sectional view showing the first variation of the first embodiment;

FIG. 3 is a view from an arrow A3 in FIG. 1;

FIG. 4 is a main portion explanatory view showing the second variation of the first embodiment;

FIG. 5 is an explanatory view for explaining thermal expansion of a main portion and change in a side clearance due to the thermal expansion in the first embodiment;

FIG. 6 is an explanatory view for explaining a principle of a structure for decreasing the change in the side clearance in the second embodiment;

FIG. 7 is a cross sectional side surface view showing the second embodiment of the present invention;

FIG. 8 is a cross sectional side surface view showing the third embodiment of the present invention;

FIG. 9 is a cross sectional side surface view showing the fourth embodiment of the present invention;

FIG. 10 is a cross sectional side surface view showing the fifth embodiment of the present invention; and FIG. 11 is a cross sectional side surface view showing the sixth embodiment of the present invention.

DETAILED DESCRIPTION

Hereinafter, embodiments of the present invention will be explained with reference to the attached drawings. In the attached drawings, to the same members are attached the same numerals, and overlapping explanations are omitted. At first, the first embodiment of the present invention will be explained with reference to FIGS. 1 to 4.

In FIG. 1, a vane pump to which the numeral 100 is attached is a pump for sucking and discharging fluid such as gasoline vapor by changing pressure in a space constituted by an outer peripheral surface of a rotor 1 and an inner wall surface of a casing 2. The vane pump 100 is provided with the rotor 1, the casing 2, a shaft 3, a pump main body 6 and a lid 11 (cover). In addition, in the attached drawings are omitted illustrations of vanes. On a side surface of the pump main body 6 on the rotor 1 side (left side in FIG. 1), the casing 2 for accommodating the rotor 1 is fixed to the pump main body 6 by fixing means not shown. On a side surface of the casing 2 opposing to the pump main body 6 (left side in FIG. 1) is arranged the lid 11 (cover), and the lid 11 is fixed through the casing 2 to the pump main body 6 by fastening means not shown.

On a side surface of the pump main body 6 on the rotor 1 and casing 2 sides (left side in FIG. 1) is arranged the first side plate 13. Then, between the rotor 1 (or vanes not shown) and the first side plate 13 is formed a side clearance CL1 on the pump main body 6 side. On the other hand, in the lid 11, on the rotor 1 (casing 2) side (right side in FIG. 1) is arranged the second side plate 14. Then, between the rotor 1 (or vanes not shown) and the second side plate 14 is formed a side clearance CL2 on the lid 11 side. Here, arranging the first and second side plates 13, 14 allows materials of the pump main body 6 and the lid 11 to be selected regardless of surface roughnesses and wear resistances thereof, which increases flexibility of material selection.

In the pump main body 6 is formed a space for accommodating the shaft and bearings, and in the space are arranged the first bearing 7 (the bearing on a side separated from the rotor 1) and the second bearing 8 (the bearing on the rotor 1 side), and the first and second bearings support the shaft 3. Between the first and second bearings 7, 8 is arranged a spacer 15, and an inner ring of the first bearing 7 and the spacer 15 are adjacently arranged through the first stopper 16 fixed to the shaft 3. On the rotor 1 side (left side in FIG. 1) of an outer ring of the second bearing 8 is connected an end of an elastic material 17 (such as spring), and the other end of the elastic material 17 is connected to the second stopper 18 fixed to the pump main body 6. The elastic material 17 energizes the shaft 3 through the second bearing 8, the spacer 15 and the first stopper 16 in a direction separated from the rotor 1 (right side in FIG. 1). On the shaft 3, an oil seal 19 faces the elastic material 17 via the second stopper 18 (left side in FIG. 1).

In FIG. 1, in a concave portion (blind hole) 1A for mounting formed on an end surface of the rotor 1 on the lid 11 side (left side in FIG. 1) is arranged a stud bolt 10 extending in a direction of the axis of the shaft 3. The stud bolt 10 is a bolt for fixing the rotor 1 to the shaft 3, and a female screw 3A formed on an end portion of the shaft 3 on the rotor 1 side and the stud bolt 10 are screwed with each other. Near an end surface of the rotor 1 on the pump main body 6 side (right side in FIG. 1) is formed a step portion 1B, and the step portion 1B engages with a step portion 3B of the shaft 3, and the step portion 1B has a complementary shape with the step portion 3B. When the rotor 1 is fixed to the shaft 3, the rotor 1 is sandwiched by the stud bolt 10 and the step portion 3B at the step portion 1B, and the stud bolt 10 is fastened to fix the rotor 1 to the shaft 3. Since a fixing structure with the stud bolt 10 extending in the direction of the axis of the shaft 3 is adopted, it is unnecessary to fix the rotor 1 to the shaft 3 (by a bolt or the like) from a direction perpendicular to the shaft as a conventional technique.

With the first embodiment adopting the fixing structure with the stud bolt 10 extending in the direction of the axis of the shaft 3, a force for fixing the rotor 1 to the shaft 3 increases, and even if large external force or temperature change (difference in coefficients of thermal expansion of the materials) generates, it is difficult to misalign positional relationship between the rotor 1 and the shaft 3 in comparison to a conventional technique for fixing a rotor to a shaft by friction force of a stud bolt only. Under a condition that the rotor 1 is sandwiched by the stud bolt 10 and the step portion 3B, the stud bolt 10 is fastened to fix the rotor 1 to the shaft 3, so that they are firmly and certainly fixed to each other. In addition, in the fixing structure with the stud bolt 10 extending in the direction of the axis of the shaft 3, unlike the conventional technique, a bolt extending in a direction perpendicular to the axis of the shaft 3 does not exist, so that it is unnecessary to drill a through hole for the bolt on the rotor 1 and to press the shaft 3 from a side direction thereof to fix the rotor 1 to the shaft 3.

Further, even if the rotor 1 turns around the stud bolt 10 by fastening force of the bolt 10, the rotor 1 turns around the axis of the shaft 3, so that the stud bolt 10 does not incline with respect to the shaft 3, and it is maintained that the shaft 3 and a side surface of the rotor 1 are perpendicular to each other. Still further, when the shaft 3 and rotor 1 are assembled, a reaction force at the assembling does not act in a direction perpendicular to the axis of the shaft 3, so that a force acting in the direction does not generate, which allows the shaft 3 and the rotor 1 to be maintained in parallel with each other. In addition, roughness and the like of an end face of the stud bolt 10 do not become a factor for inclining the rotor 1 with respect to a position perpendicular to the shaft 3. Therefore, the rotor 1 does not incline with respect to the position perpendicular to the shaft 3, and the side clearance can be properly maintained. Then, as a result that the side clearance is properly maintained, there is no fear that the rotor 1 and the shaft 3 are in a locked state.

Here, near an end face of the rotor 1 on the pump main body 6 side, instead of engagement between the step portion 1B of the rotor 1 and the step portion 3B of the shaft 3, by a structure shown in FIG. 2, the rotor 1 can be fixed to the shaft 3. In FIG. 2 showing the first variation of the first embodiment, on a shaft 3-1 is formed a key channel 3-1A, and an end surface of a key 20 inserted into the key channel 3-1A (left end surface in FIG. 2) contacts the rotor 1, and the other end surface contacts a side surface of the key channel 3-1A. Fastening the stud bolt 10 causes the key 20 that is inserted into the key channel 3-1A formed on the shaft 3-1 to be sandwiched by the rotor 1 and a wall surface of the key channel 3-1A of the shaft 3-1, which allows the rotor 1 to be fixed to the shaft 3-1. With the variation shown in FIG. 2, it becomes unnecessary to form the step portion 1B and the step portion 3B on the rotor 1 and the shaft 3 respectively.

In FIG. 1 again, outside the first bearing 7 (outside the pump main body 6: on a side separated from the rotor 1: near a right end portion of the shaft 3 in FIG. 1) is arranged a side clearance adjusting member 4. But, as explained with the fifth and sixth embodiments shown in FIGS. 10 and 11, the side clearance adjusting member 4 can be arranged at a position other than outside the first bearing 7 (outside the pump main body 6: on the side separated from the rotor 1: near the right end portion of the shaft in FIG. 1). The side clearance adjusting member 4 is a member with an approximately cylindrical shape including a through hole 4A that the shaft 3 penetrates in a radially central portion, and on a radially outer side of the side clearance adjusting member 4 is formed a male screw 4B. Since the male screw 4B of the side clearance adjusting member 4 is screwed to the female screw 6A of the pump main body 6, when the side clearance adjusting member 4 is rotated, the side clearance adjusting member 4 relatively moves with respect to the pump main body 6 in the axial direction of the shaft 3.

A portion 4C (rotating tool engaging portion) of the side clearance adjusting member 4 on a side separated from the rotor 1 (right side in FIG. 1) is formed in a hexagonal shape for example (refer to FIG. 3). When the side clearance adjusting member 4 is moved in a direction of the axis of the shaft 3 (is relatively moved with respect to the pump main body 6), a tool with a complementary shape is engaged with the rotating tool engaging portion 4C with the hexagonal shape to rotate it. In this connection, a radially inner portion (penetrating portion 4A) of the side clearance adjusting member 4 does not contact the shaft 3.

For example, in a process that the lid 11 is attached to finish the work assembling the vane pump 100, a distance between the rotor 1 and an end surface of the casing 2 (difference in positions in the axial direction of the shaft 3) is measured as a side clearance CL2 by a dial depth gage or the like, and a side clearance CL1 on the pump main body 6 side is determined. When the side clearance CL1 on the pump main body 6 side of the rotor 1 is too small (when the side clearance CL2 on the lid 11 side is too large), the side clearance adjusting member 4 is rotated in a fastening direction (as the side clearance adjusting member 4 moves on the rotor 1 side).

Fastening the side clearance adjusting member 4 causes the shaft 3 to move on the rotor side (left side in FIG. 1) through an outer ring, balls and an inner ring of the first bearing 7 and the first stopper 16. As a result, the side clearance CL1 on the pump main body 6 side is enlarged, and the side clearance CL2 on the lid 11 side decreases. At that time, through the first bearing 7, the spacer 15 and the second bearing 8, toward the rotor 1 is compressed the elastic material 17.

On the other hand, when the side clearance CL1 on the pump main body 6 side is too large (when the side clearance CL2 on the lid 11 side is too small), the side clearance adjusting member 4 is rotated in an unfastening direction (in a direction separated from the rotor 1). When the side clearance adjusting member 4 is unfastened to move in a direction separated from the rotor 1, by an elastic repulsive force of the elastic material 17 that has been compressed toward the rotor 1, the outer ring of the second bearing 8 is pressed in a direction separated from the rotor 1 (right side in FIG. 1), and through balls and an inner ring of the second bearing 8, the spacer 15 and the first stopper 16, the shaft 3 is moved in a direction separated from the shaft 3 (right side in FIG. 1). As a result, the side clearance CL1 on the pump main body 6 side decreases, and the side clearance CL2 on the lid 11 side is enlarged. When the side clearance adjusting member 4 is moved in a direction separated from the rotor 1, the second bearing 8, the spacer 15 and the first bearing 7 move in a direction separated from the rotor 1 also until the first bearing 7 contacts the side clearance adjusting member 4. In other words, the shaft 3 moves in a direction separated from the rotor 1 (right side in FIG. 1) by an unfastening amount of the side clearance adjusting member 4. After the side clearance adjusting member 4 is handled to adjust the side clearances CL1, CL2, the lid 11 is attached to the pump main body 6.

With the first embodiment shown in the drawings, in the process that the lid 11 is attached to finish the work assembling the vane pump 100, even if it is measured that values of the side clearances CL1, CL2 are inappropriate, without disassembling assembled parts, appropriately rotating the side clearance adjusting member 4 can set the side clearances CL1, CL2 to be proper values. When the side clearances CL1, CL2 are set to be proper values in this way, it becomes unnecessary to assemble the vane pump 100 while a thickness gage is sandwiched by the rotor 1 and the pump main body 6, so that assembling work becomes easy. In addition, when vanes (not shown) are worn to be replaced, the pump main body 6 and the casing 2 must be disassembled and reassembled. At this time, even if the side clearances CL1 and CL2 become improper values, the side clearance adjusting member 4 can be rotated to move the shaft 3 in a direction of the rotor 1 or a direction separated from the rotor 1, so that replacement of the worn vanes and assembling of the vane pump can be performed easily and surely, and the side clearances CL1, CL2 can be set to be proper values.

Here, it is necessary that the side clearance adjusting member 4 is made immovable (non-rotatable) after the side clearances CL1, CL2 are adjusted to the proper values by the side clearance adjusting member 4, because the side clearances CL1, CL2 adjusted to the proper value change when the side clearance adjusting member 4 moves (rotates) as described above. As shown in FIG. 3 viewed from an arrow A3 in FIG. 1, with the first embodiment, as described above, on an end portion of the side clearance adjusting member 4 on a side separated from the rotor 1 (right side in FIG. 1) is formed the rotating tool engaging portion 4C, and the rotating tool engaging portion 4C is formed of a hexagonal nut.

On a detent (locking means) 5 of the side clearance adjusting member 4 are formed six or more concave portions 5A (12 portions in FIG. 3) into which corners of the hexagonal nut fit separately. In addition, on a radially outer side of the detent 5, long holes 5B (two holes in FIG. 3) are arranged at equal intervals in a circumferential direction, and the detent 5 is fixed through the long holes 5B to the pump main body 6 by fastening members 21. Therefore, under a condition that the side clearance becomes proper value, relative position of the detent 5 to the rotating tool engaging portion 4C of the side clearance adjusting member 4 is adjusted in such a manner that the six corners of the rotating tool engaging portion 4C (hexagonal nut) are separately fitted into the concave portions 5A of the detent 5, and the detent 5 is fixed through the long holes 5B to the pump main body 6 by the fastening members 21. With this, as shown in FIG. 3, the detent 5 fixes the side clearance adjusting member 4 so as not to rotate.

In addition, types of the side clearance adjusting member 4 and the detent 5 are not limited to those shown in FIG. 3. Like the second variation shown in FIG. 4 can be constituted a rotating tool engaging portion 4C-1 of the side clearance adjusting member 4 and a detent 5-1. As shown in FIG. 4(A), on a radially outer side of the rotating tool engaging portion 4C-1 of the side clearance adjusting member 4 according to the second variation are formed convex portions 4C-1A (two portions in FIG. 4(A)), and the rotating tool engaging portion 4C-1 has a circular shape. In addition, on the rotating tool engaging portion 4C-1 are formed pin insertion holes 4C-1B (two holes in FIG. 4(A)) into which pins 22A of the rotating tool 22 shown in FIG. 4(C) are inserted. On the other hand, on the detent 5-1 shown in FIG. 4(B) are formed concave portions 5-1A with which the convex portions 4C-1A of the rotating tool engaging portion 4C-1 engage. In addition, on a radially outer side of the detent 5 are formed long holes 5-1B (two portions in FIG. 4), and the detent 5-1 are fixed through the long holes 5-1B to the pump main body 6 (refer to FIGS. 1 and 3) by fastening members.

In order to prevent rotation of the side clearance adjusting member 4 at the position thereof when the side clearances CL1, CL2 (refer to FIG. 1) become proper, each of the convex portions 4C-1A of the rotating tool engaging portion 4C-1 are fitted into each of the concave portions 5-1A of the detent 5-1. Relative position of the detent 5-1 to the rotating tool engaging portion 4C-1 is adjusted in such a manner that each of the convex portions 4C-1A is fitted into each of the concave portions 5-1A of the detent 5-1 to fix the detent 5-1 through the long holes 5-1B to the pump main body 6 (refer to FIGS. 1 and 3) by fastening members, which allows the side clearance adjusting member 4 to be fixed to the pump main body 6 without rotating. Here, in case that the side clearances CL1, CL2 (refer to FIG. 1) is adjusted, the detent 5-1 is detached from the rotating tool engaging portion 4C-1, and the pins 22A of the rotating tool 22 shown in FIG. 4(C) are inserted into the pin insertion holes 4C-1B of the rotating tool engaging portion 4C-1 of the side clearance adjusting member 4 shown in FIG. 4(A) to rotate the side clearance adjusting member 4.

FIG. 5 shows a main portion of the displacement pump 100 according to the first embodiment. In the displacement pump 100, total axial length of the pump main body 6 affects the side clearances CL1, CL2 when thermal expansion generates. In FIG. 5 also, like FIG. 1, the symbol CL1 indicates a side clearance on the pump main body 6 side of the rotor 1 (the first side plate 13 side: left side in FIG. 5), and the symbol CL2 indicates a side clearance on the lid 11 (cover) side of the rotor 1 (the second side plate 14 side: right side in FIG. 5).

As described above with reference to FIG. 1, in FIG. 5 also, moving the side clearance adjusting member 4 relative to the pump main body 6 (in a direction of the axis of the shaft 3), the shaft 3 and the rotor 1 fixed to the shaft 3 move (in the direction of the axis of the shaft 3) to increase or decrease the side clearances CL1, CL2. In FIG. 5, thermal expansion coefficient ($23.8\times10^{-6}$/° C.) of a material (for example, aluminum) constituting the pump main body 6 is larger than that ($12.1\times10^{-6}$/° C.) of a material (for example, S45C) constituting the shaft 3 and the rotor 1. Therefore, when the pump becomes hot (for example, 135° C.), difference between liner displacement of the shaft 3 and the rotor 1 (in the direction of the axis of the shaft 3) due to the thermal expansion and liner displacement of the pump main body 6 (in the direction of the axis of the shaft 3) due to the thermal expansion decreases the side clearances CL1 and increases the side clearances CL2.

On the contrary, in the second embodiment, as shown in FIG. 6, between the side clearance adjusting member 4 and the first bearing 7 is mounted a thermal expansion adjusting member 9, and the thermal expansion adjusting member 9 is formed of a material (for example, resin) whose thermal expansion coefficient is higher than that of a material (for example, aluminum) constituting the pump main body 6. In the same manner as explained in the first embodiment, at an end portion of the shaft 3 on a side separated from the rotor 1 (left side in FIG. 5), the side clearance adjusting member 4 is screwed to the pump main body 6. In case that a vane pump 101 (refer to FIG. 7) according to the second embodiment operates under high temperature environment, the side clearance adjusting member 4 is screwed and fixed to the pump main body 6, so that in FIG. 6, the thermal expansion adjusting member 9 expands in the direction of the axis of the shaft 3 to press the first bearing 7 on the rotor 1 side (right side in FIG. 6). As a result, the shaft 3 is pressed on the rotor 1 side (right side in FIG. 6) also, so that the side clearance CL1 between the shaft 3 and the pump main body 6 (or the side plate 13) increases, and the side clearance CL2 decreases. Even if the side clearance CL1 becomes small due to the difference in coefficient of thermal expansion between the material (for example, aluminum) constituting the pump main body 6 and the material (for example, S45C) constituting the shaft 3 and the rotor 1, expansion of the thermal expansion adjusting member 9 in the direction of the axis of the shaft 3 increases the side clearance CL1, and fluctuation of the side clearance CL1 decreases as a whole. Fluctuation of the side clearance CL2 decreases also. Therefore, fluctuations of the side clearances CL1 and CL2 of the rotor 1 due to the difference in coefficients of thermal expansion of the materials are mitigated.

The inventor measured the fluctuations ΔCL1 and ΔCL2 of the side clearances CL1 and CL2 due to thermal expansion. The inventor measured them under the condition that: the pump main body 6 is constituted by aluminum (thermal expansion coefficient: $23.8\times10^{-6}$/° C.); the shaft 3 and the rotor 1 are constituted by S45C (thermal expansion coefficient: $12.1\times10^{-6}$/° C.); the thermal expansion adjusting member 9 is constituted by resin; length L1 between an origin (rotor 1 side end surface of side clearance adjusting member 4) and the casing 2 is about 53 mm; casing height L2 is about 25 mm; and temperature of the pump is increased to about 130° C.-140° C. With the measurement by the inventor, as shown in FIG. 5, it is confirmed that the fluctuations ΔCL1 and ΔCL2 of the side clearances CL1 and CL2 when the thermal expansion adjusting member 9 is mounted reduce to 1/85 or less as compared to those when the thermal expansion adjusting member 9 is not mounted. Reducing the fluctuations ΔCL1 and ΔCL2 of the side clearances CL1 and CL2 to such extent does not generate inconvenience to operation of the vane pump 101.

A vane pump according to the second embodiment shown in FIG. 7 is constituted by adding the thermal expansion adjusting member 9 explained with FIG. 6. In FIG. 7, the numeral 101 indicates a whole vane pump according to the second invention. The vane pump 101 has the thermal expansion adjusting member 9 between the side clearance adjusting member 4 and the first bearing 7 for rotatably supporting the shaft 3. As a material of the thermal expansion adjusting member 9 can be selected a material whose thermal expansion coefficient is larger than that of the pump main body 6 accommodating the shaft 3. For example, when the pump main body 6 is constituted by aluminum (thermal expansion coefficient: $23.8\times10^{-6}$/° C.), the thermal expansion adjusting member 9 is constituted by resin.

With the second embodiment shown in FIGS. 6 and 7, when the van pump 101 is driven under high temperature environment, due to the difference in coefficient of thermal expansion between the material (for example, aluminum) constituting the pump main body 6 and the material (for example, S45C) constituting the shaft 3 and the rotor 1, even if the side clearance CL1 on the pump main body 6 side decreases and the side clearance CL2 on the lid 11 side increases, the thermal expansion adjusting member 9 expands in the direction of the axis of the shaft 3, and the side clearance CL1 on the pump main body 6 side becomes large and the side clearance CL2 on the lid 11 side becomes small. As a result, fluctuations of the side clearances CL1 and CL2 of the rotor 1 totally become small, effect of the fluctuations due to thermal expansion are mitigated. Other construction and action effects of the second embodiment shown in FIGS. 6 and 7 are the same as those of the first embodiment shown in FIGS. 1 to 4.

The side clearance adjusting member 4 of the first embodiment shown in FIGS. 1 to 4 is effective regardless of fixing mode between the shaft 3 and the rotor 1. For example, in the first embodiment shown in FIGS. 1 to 4, the shaft 3 and the rotor 1 are fixed by the stud bolt 10 extending in a direction of the axis of the shaft 3 (the stud bolt 10 for fixing the rotor 1 to the shaft 3). In contrast, in a vane pump 102 according to the third embodiment shown in FIG. 8, to a female screw 1C formed on the rotor 1 is screwed a bolt 23 (set screw) extending in a direction perpendicular to the axis of the shaft 3. Fastening the set screw 23 allows an end of the set screw 23 on the shaft 3 side to press a pressurized surface 3C formed on the shaft 3, which fixes the rotor 1 to the shaft 3. Other constructions and action effects of the third embodiment shown in FIG. 8 are the same as those of the first embodiment shown in FIGS. 1 to 4.

The thermal expansion adjusting member 9 according to the second embodiment shown in FIGS. 6 and 7 is also effective regardless of the fixing mode between the shaft 3 and the rotor 1. In the second embodiment shown in FIGS. 6 and 7, the shaft 3 and the rotor 1 are fixed by the stud bolt 10 extending in a direction of the axis of the shaft 3 (the stud bolt 10 for fixing the rotor 1 to the shaft 3). In contrast, in a vane pump 103 according to the fourth embodiment shown in FIG. 9, the bolt 23 (set screw) extending in a direction perpendicular to the axis of the shaft 3 is screwed to the female screw 1C formed on the rotor 1. Then, the set screw 23 is fastened to press an end of the set screw 23 on the shaft 3 side to a pressurized surface 3C formed on the shaft 3, which fixes the rotor 1 to the shaft 3. Other constructions and action effects of the fourth embodiment shown in FIG. 9 are the same as those of the second embodiment shown in FIGS. 6 and 7.

In the first to fourth embodiments shown in FIGS. 1 to 9, the side clearance adjusting member 4 is arranged near an end portion of the shaft 3 separated from the rotor 1 (right end portions in FIGS. 1, 7 to 9). However, if the side clearance adjusting member 4 can be rotated, it is unnecessary that position of the side clearance adjusting member 4 is limited to the end portion of the shaft 3 separated from the rotor 1 (right end portions in FIGS. 1, 7 to 9). In a vane pump 104 according to the fifth embodiment shown in FIG. 10, the side clearance adjusting member 4 is arranged near the rotor 1 of the second bearing 8. In FIG. 10, a male screw 4B of the side clearance adjusting member 4 and a female screw 6A of the pump main body 6 are screwed with each other. Therefore, when rotating with respect to the shaft 3, the side clearance adjusting member 4 moves in a direction of the axis of the shaft 3, and moves in relation to the pump main body 6.

When the side clearance adjusting member 4 is moved on a side separated from the rotor 1 (right side in FIG. 10), through an outer ring of the second bearing 8, balls of the second bearing 8, an inner ring of the second bearing 8 and the third stopper 24 fixed to the shaft 3, the shaft 3 is moved on the side separated from the rotor 1. As a result, the side clearance CL1 on the pump main body 6 side (side clearance between the first side plate 13 and the rotor 1) decreases, and the side clearance CL2 on the lid 11 side (side clearance between the second side plate 14 and the rotor 1) increases. And, through the second bearing 8, the third stopper 24, the spacer 15 and the first bearing 7, the elastic body 25 is pressed. Here, both ends of the elastic body 25 are connected to the first bearing 7 and the fourth stopper 26 fixed to an end portion of the pump main body 6 respectively.

On the other hand, moving the side clearance adjusting member 4 to the rotor 1 (left side in FIG. 10) allows an outer ring of the first bearing 7 to be pressed by an elastic repulsive force of the elastic body 25, and through the balls of the first bearing 7, the inner ring of the first bearing 7, the spacer 15 and the third stopper 24, the shaft 3 is moved on the rotor 1 side (left side in FIG. 1). As a result, the side clearance CL1 on the pump main body 6 side increases, and the side clearance CL2 on the lid 11 side decreases. In addition, when the side clearance adjusting member 4 is moved on the rotor 1 side, the second bearing 8, the spacer 15 and the first bearing 7 also move on the rotor 1 side until the second bearing 8 abuts the side clearance adjusting member 4. In other words, the shaft 3 moves on the rotor 1 side (left side in FIG. 1) by an amount that the side clearance adjusting member 4 is loosened.

In the fifth embodiment shown in FIG. 10, the side clearance adjusting member 4 is arranged on the rotor 1 side from the second bearing 8, under high temperature environment, changes of the side clearances CL1, CL2 of the rotor 1 due to difference in thermal expansion coefficient relates to an area of the length shown by the symbol L10 in the direction of the axis of the shaft 3 of the pump main body 6. The length shown by the symbol L10 is much smaller than the total length of the shaft 3 of the pump main body 6 in the axial direction thereof, so that with the construction shown in FIG. 10, heat expansion under high temperature becomes small in comparison to the embodiments shown in FIGS. 1 and 8. As a result, in the fifth embodiment shown in FIG. 10, the thermal expansion adjusting member 9 in each embodiment shown in FIG. 6, FIG. 7 and FIG. 9 is not mounted. Without the thermal expansion adjusting member 9, disadvantages due to changes of side clearances of the rotor 1 are small. However, although illustration is omitted, it is possible to mount the thermal expansion adjusting member 9. Other constructions and action effects of the fifth embodiment shown in FIG. 10 are the same as those of the embodiments shown in FIGS. 1 to 9.

FIG. 11 shows the sixth embodiment of the present invention. In the vane pump 104 of the fifth embodiment, the shaft 3 and the rotor 1 are fixed with the stud bolt 10 (stud bolt for fixing the rotor to the shaft) extending in the direction of the axis of the shaft 3. On the contrary, in the sixth embodiment shown in FIG. 11, like the third embodiment shown in FIG. 8 and the fourth embodiment shown in FIG. 9, the bolt 23 (set screw) extending in a direction perpendicular to the axis of the shaft 3 is screwed to the female screw 1C formed on the rotor 1. Then, fastening the bolt 23 allows an end of the shaft 3 on the bolt 23 side to be pressed to the pressurized surface 3C formed on the shaft 3, which fixes the rotor 1 to the shaft 3. Other construction and action effects of the sixth embodiment shown in FIG. 11 are the same as those of the fifth embodiment shown in FIG. 10.

Since the embodiments shown in the drawings are merely examples, and the embodiments do not limit the technical scope of the present invention.

DESCRIPTION OF THE REFERENCE NUMERALS

1 rotor
2 casing
3 shaft
4 side clearance adjusting member
5 detent
6 pump main body
7 first bearing
8 second bearing
9 thermal expansion adjusting member
10 stud bolt
11 lid (cover)
13, 14 side plates
100, 101, 102, 103, 104, 105 vane pumps (displacement pumps)
CL1, CL2 side clearances

What is claimed is:

1. A displacement pump for sucking and discharging a fluid by changing pressure in a space constituted by an outer peripheral surface of a rotor and an inner wall surface of a casing, the displacement pump comprising:

a pump main body having a wall with an opening formed therein;

a shaft aligned with the opening of the pump main body and coupled to the rotor;

a first bearing configured to rotatably support the shaft within the pump main body, the first bearing having an outer ring and an inner ring, the outer ring being axially moveable relative to the inner ring; and a side clearance adjusting member configured to be rotatably moveable and axially moveable relative to the pump main body and configured to be rotatable relative to the shaft;

the pump main body, the side clearance adjusting member and the shaft being operatively connected such that rotation of the side clearance adjusting member relative to the pump main body and the shaft causes movement of the shaft relative to the pump main body to facilitate adjustment of a clearance between the pump main body and the rotor, and further comprising:

a second bearing configured to rotatably support the shaft within the pump main body, the second bearing having an outer ring and an inner ring, the outer ring being axially moveable relative to the inner ring; and a spacer extending between and in contact with the first bearing and the second bearing.

2. The displacement pump as claimed in claim 1, further comprising a detent for the side clearance adjusting member.

3. The displacement pump as claimed in claim 2, wherein said side clearance adjusting member is screwed to the pump main body at an end portion of the shaft on a side separated from the rotor, and a thermal expansion adjusting member is arranged between the side clearance adjusting member and the first bearing, an a thermal expansion coefficient of the thermal expansion adjusting member is larger than that of the pump main body for accommodating the shaft.

4. The displacement pump as claimed in claim 2, wherein the shaft and the rotor are fixed to each other by a bolt extending in an axial direction of the shaft.

5. The displacement pump as claimed in claim 1, wherein said side clearance adjusting member is screwed to the pump main body at an end portion of the shaft on a side separated from the rotor, and a thermal expansion adjusting member is arranged between the side clearance adjusting member and the first bearing, a thermal expansion coefficient of the thermal expansion adjusting member is larger than that of the pump main body for accommodating the shaft.

6. The displacement pump as claimed in claim 5, wherein the shaft and the rotor are fixed to each other by a bolt extending in an axial direction of the shaft.

7. The displacement pump as claimed in claim 1, wherein the shaft and the rotor are fixed to each other by a bolt extending in an axial direction of the shaft.

8. The displacement pump as claimed in claim 1, wherein the side clearance adjusting member is coupled to the pump main body via threaded engagement.

9. The displacement pump as claimed in claim 1, wherein the side clearance adjustment member is directly coupled to the pump main body.

10. The displacement pump as claimed in claim 1, wherein the outer ring of the first bearing is in abutting contact with the side clearance adjusting member and is moveable in an axial direction relative to the pump main body with the side clearance adjusting member.

11. The displacement pump as claimed in claim 1, wherein the outer ring of the first bearing is moveable in an axial direction relative to the pump main body with the side clearance adjusting member.

12. The displacement pump as claimed in claim 1, wherein the side clearance adjusting member is in abutting contact with the outer ring of the first bearing such that incremental adjustment of the side clearance adjustment member facilitates incremental adjustment of the outer ring of the first bearing relative to the inner ring of the first bearing.

13. The displacement pump as claimed in 12, further comprising:

the outer rings of both the first and second bearings being axially moveable relative to the spacer.

14. The displacement pump recited in claim 13, wherein the spacer is disposed about the shaft and moves in concert with the inner rings of the first and second bearings.

15. A displacement pump for sucking and discharging a fluid by changing pressure in a defined space, the displacement pump comprising:

a pump main body having a wall with an opening formed therein;

a shaft aligned with the opening of the pump main body;

a bearing configured to rotatably support the shaft within the pump main body, the bearing having an outer ring and an inner ring, the outer ring being axially moveable relative to the inner ring;

a rotor coupled to the shaft and located adjacent the pump main body such that a clearance is defined between the rotor and the pump main body; and a side clearance adjuster configured to be rotatably moveable and axially moveable relative to the pump main body;

the pump main body, the shaft, and the side clearance adjuster being configured such that rotation of the side clearance adjuster relative to the pump main body causes movement of the shaft relative to the pump main body via selective incremental action of the side clearance adjuster on the outer ring relative to the inner ring to facilitate adjustment of the clearance between the rotor and the pump main body, and further comprising:

a second bearing configured to rotatably support the shaft within the pump main body, the second bearing having an outer ring and an inner ring, the outer ring being axially moveable relative to the inner ring; and a spacer extending between and in contact with the first bearing and the second bearing.

16. The displacement pump as claimed in claim 15, wherein the outer ring of the bearing is in abutting contact with the side clearance adjusting member and is moveable in an axial direction relative to the pump main body with the side clearance adjusting member.

17. The displacement pump as claimed in claim 15, wherein the outer ring of the bearing is moveable in an axial direction relative to the pump main body with the side clearance adjusting member.

* * * * *